US006834849B2

(12) United States Patent
Hendle et al.

(10) Patent No.: US 6,834,849 B2
(45) Date of Patent: Dec. 28, 2004

(54) DEVICE FOR CUTTING PAPER WEBS

(75) Inventors: Thomas Hendle, Würzburg (DE); Johannes Georg Schaede, Würzburg (DE); Anton Weis, Lorsch (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 168 days.

(21) Appl. No.: 10/239,874

(22) PCT Filed: Apr. 2, 2001

(86) PCT No.: PCT/DE01/01285

§ 371 (c)(1),
(2), (4) Date: Oct. 4, 2002

(87) PCT Pub. No.: WO01/76835

PCT Pub. Date: Oct. 18, 2001

(65) Prior Publication Data

US 2003/0097918 A1 May 29, 2003

(30) Foreign Application Priority Data

Apr. 6, 2000 (DE) ..... 100 17 288

(51) Int. Cl.[7] ..... B41F 13/56

(52) U.S. Cl. ..... 270/21.1; 101/227; 242/526.3; 83/177

(58) Field of Search ..... 101/222, 227, 101/226; 270/5.02, 5.03, 21.1; 242/526.3; 83/177

(56) References Cited

U.S. PATENT DOCUMENTS

| | | | | | |
|---|---|---|---|---|---|
| 2,506,445 | A | | 5/1950 | Donning | |
| 4,137,804 | A | | 2/1979 | Gerber et al. | |
| 4,140,038 | A | * | 2/1979 | Higgins | 83/177 |
| 4,182,170 | A | * | 1/1980 | Grupp | 83/177 |
| 4,266,112 | A | | 5/1981 | Niedermeyer | |
| 4,966,059 | A | * | 10/1990 | Landeck | 83/177 |
| 5,445,055 | A | * | 8/1995 | Koponen et al. | 83/177 |
| 5,531,396 | A | * | 7/1996 | Kinnunen | 242/526.3 |
| 5,571,381 | A | * | 11/1996 | Vessari et al. | 162/195 |
| 5,730,358 | A | | 3/1998 | Raghavan et al. | |
| 5,794,854 | A | * | 8/1998 | Yie | 239/242 |
| 5,797,320 | A | | 8/1998 | Buschulte et al. | |
| 5,927,329 | A | * | 7/1999 | Yie | 137/624.13 |
| 5,951,242 | A | * | 9/1999 | Graf | 415/90 |
| 5,961,758 | A | * | 10/1999 | Honegger | 156/73.1 |
| 6,001,219 | A | * | 12/1999 | Caspar | 162/286 |
| 6,364,240 | B1 | * | 4/2002 | Madrzak et al. | 242/526.3 |
| 6,467,720 | B1 | * | 10/2002 | Madrzak et al. | 242/526.3 |

FOREIGN PATENT DOCUMENTS

| | | |
|---|---|---|
| DE | 91 03 749.2 | 8/1991 |
| DE | 93 17 447.0 | 3/1994 |
| WO | WO 97/11814 | 4/1997 |

OTHER PUBLICATIONS

Emeriau, L.; "La Decoupe Par Jet D'Eau"; Caractere, CEP Information Professions; Jan. 15, 1991; pp. 36–39; Paris, FR.

Technische Rundschau; No. 18; May 8, 1973; pp. 25, 27, 29, 31.

* cited by examiner

*Primary Examiner*—Eugene H. Eickholt
(74) *Attorney, Agent, or Firm*—Jones, Tullar & Cooper PC

(57) ABSTRACT

A water jet cutting device is used to cut a paper web into a plurality of partial paper webs. The water jet cutting device is placed between the output of a web-fed rotary printing press and the input of a folder which folds the plurality of partial paper webs.

44 Claims, 4 Drawing Sheets

Fig. 1
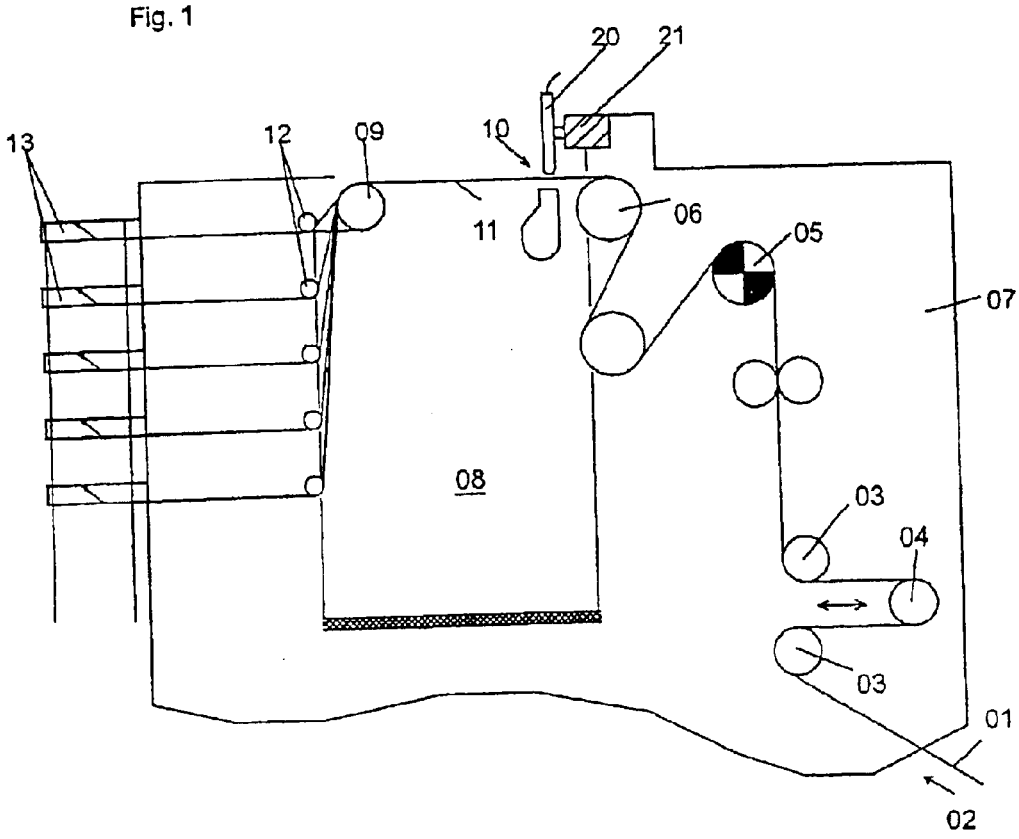
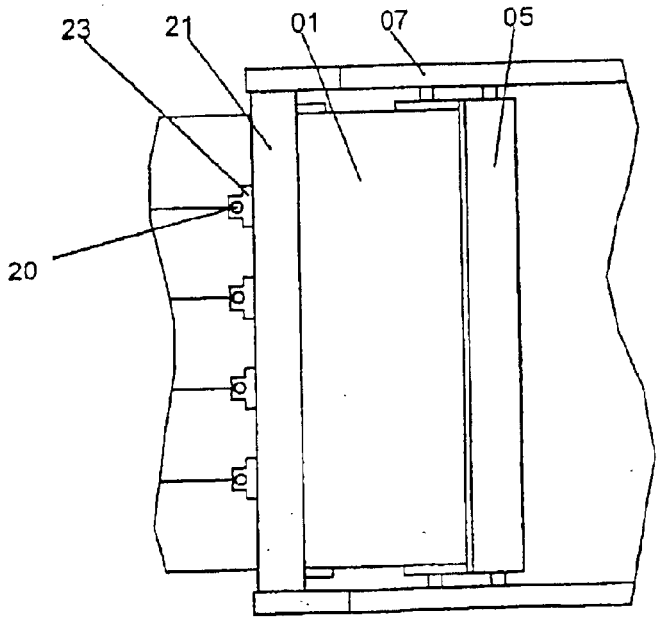
Fig. 2

DEVICE FOR CUTTING PAPER WEBS

FIELD OF THE INVENTION

The present invention is directed to a device for cutting paper webs. A water jet device is used to cut the paper webs.

BACKGROUND OF THE INVENTION

Paper web cutting devices are employed, for example, in high-speed web-fed printing presses which presses may be used for printing illustrated and other printed products with large numbers of copies. The cutting devices are used to divide a wide web, on which several pages of the printed products have been printed side-by-side, into partial webs, each of which partial web corresponds to a single page. The partial webs separated in this way are bundled and are then fed to the folding apparatus.

A device for cutting a moving web by use of a water jet is known from U.S. Pat. No. 4,266,112, but the questions of what material the web can be made of is left open. The suitability of this device for cutting a paper web cannot be determined from this publication because one skilled in the art, knowing that paper has the tendency to absorb water and to then swell, would assume that this will also occur if this device is used for cutting paper. Further than that, because of the low web speed of less than 1 m/s, this device is not suitable for being employed in connection with printing presses.

A device for a shaping processing of paper in a printing press is known from U.S. Pat. No. 5,797,320. This device uses a water jet for cutting out or perforating designs on a printed sheet.

The structure of a jet for generating a high-pressure water jet for cutting materials is known from U.S. Pat. No. 5,730,358.

A device for use in the trimming of the edges of paper webs with the aid of a water jet is known from WO 97/11814 A1. This device is employed in the course of paper production. In this case, it must be assumed that the paper to be trimmed contains residual moisture, so that moisture possibly picked up from the cutting jet is not noted in an interfering manner. No great demands are being made on the accuracy of the cutting. In particular, no accurate register is required, because the paper to be cut has not yet been imprinted.

DE 91 03 749 U1 discloses a device for cutting paper webs by use of a water jet cutting device.

Technische Rundschau [Technical Magazine], No. 18, 05/08/1973, pp. 25, 27, 29, 31 describes cutting parameters for various materials.

SUMMARY OF THE INVENTION

The object of the present invention is directed to providing a device for cutting paper webs.

In accordance with the present invention, this object is attained by the use of a water jet cutting device that can be arranged in a web-fed rotary printing press between a printing unit and the inlet of the folding apparatus. The distance of the nozzle to the paper web can be selected to optimize cutting of the web. Water pressure of greater than 3500 bar is preferably used.

The advantages which can be obtained by the present invention reside, in particular, in that it is possible to arrange such a device in a space-saving manner at any arbitrary straight section of the path of the paper web. In the vicinity close to the paper web, the subject invention requires only such sufficient installation length as corresponds to the dimensions of the jet nozzles of the cutting device.

In contrast to the device for cutting paper webs in accordance with the present invention, known cutting devices for use in printing presses include rotating so-called upper and lower cutters, between which the paper web is passed. One of these cutters also functions as a deflection roller for the paper web. In the course of operating these prior cutters, it is necessary to make absolutely sure that their circumferential speed corresponds to the running speed of the paper web to be cut, so that they do not exert braking or acceleration forces on the paper web, which forces, at the high web speeds of modern printing presses, can easily result in tearing of the paper web. Regular maintenance of these cutters is required in order to assure that the paper web is actually cleanly cut at all times and is not being torn by dull or badly aligned blades. Therefore, the blades must be accessible to the maintenance personnel, and they must be replaceable. It is thus necessary to provide access to the place where these prior cutters are installed, which has the result that the processing section, consisting of printing press, device for cutting, and folding apparatus requires considerable space.

A further advantage of the device for cutting paper webs in accordance with the present invention requires little maintenance in comparison with traditional cutter arrangements.

A further advantage of the subject invention is that dust, which might possibly be created in the course of cutting the paper, is substantially carried along by the water jet, so that it, in a manner different from a cutting device consisting of an upper and lower cutter, substantially occurs only on one side of the paper web and for this reason alone can be more easily caught. An aspiration of the dust active in the immediate vicinity of the paper web is no longer required. The suction hoods, which previously had been used for aspirating the dust and which have extended over the entire width of the web at the respective locations of the cutters and increased the space requirements of the cutting device and which made maintenance of the cutter additionally more difficult, are not required by the device for cutting paper webs in accordance with the present invention.

The distance between the cutting jet and the paper web preferably corresponds to three to ten times the sonic running time transversely in respect to the jet diameter. It is presumed that the high-speed jet generated by the nozzle passes through three phases on its path; a first one, in which it forms a coherent jet, a second, in which the coherent jet disintegrates as a result of coarse drops, and a third phase, in which the coarse drops again disintegrate and form fine droplets. In the first phase, the jet is well suited for cutting homogeneous media. In the second phase, in which the individual drops exert an intermittent force on the material to be cut, the jet is particularly suited for cutting media having an interior structure, such as grainy mineral materials, or stacks of paper with a layer structure.

While the disintegration of the jet into fine droplets probably is the result of the slowing down of the jet by air, the transition of the jet from the first phase into the second phase is a result of its surface tension. From the point of view of surface tension, or surface energy, a fine jet of constant diameter represents an unstable equilibrium. Minimal deviations of the diameter tend to grow, so that the jet is constricted and disintegrates into individual drops. The velocity with which the constriction takes place is necessarily proportional to the velocity with which pressure effects are propagated in the jet, i.e. to the speed of sound in the jet. Cutting experiments have shown that the transition from the first phase to the second phase must take place at a distance D1 from the nozzle corresponding to three to ten times the sonic running time transversely in respect to the jet, i.e. $D1=3\cdot c\cdot d<v\cdot 10\cdot c\cdot d$, where c=speed of sound in water, d=jet diameter, v=jet velocity, and D1=distance from the jet to the paper web.

Too short work distances D1, in particular of less than three times the sonic running time, are less preferred. It is presumed that the reason for this lies in the velocity distribution of the water transversely to the jet direction. As long as the water moves through the nozzle, the flow velocity in the center of the nozzle bore is considerably greater than at the edge of the nozzle bore, where the water is slowed down because of friction because of contact with the walls of the bore. This velocity. distribution is initially maintained, even when friction ceases when the jet exits from the bore. Only after a certain minimum path is the velocity distribution in the jet homogenized to the extent necessary so that the edge areas of the jet will also provide a dependable total cutting effect.

A collecting receptacle for the cutting jet is arranged on an opposite side of the web at a distance of preferably 5 to 15 mm from the web. Such a distance is short enough to dependably collect the jet after the jet has passed through the web and is sufficiently large to prevent the web from being pushed against the collecting receptacle in the case of possible fluctuations in the tension of the web.

The collecting receptacle should be constructed in such a way that it dependably slows the cutting jet down, while at the same time preventing water spray from exiting the collecting receptacle in the direction toward the web. The jet must not accomplish its cutting effect in the collecting receptacle. To this end, the collecting receptacle is provided with at least one deflecting surface, that is arranged obliquely to the jet direction, and is used for slowing the jet down. With such an oblique arrangement, only the velocity component of the jet which extends vertically in relation to the deflecting surface can exert a cutting effect. This component is proportional to the cosine of the angle which the jet forms with the normal surface extension of the deflecting surface.

A further feature or aspect which contributes to the limitation of the cutting effect of the water jet on the collecting receptacle lies in selecting the distance between the jet and the deflecting surface of the collecting receptacle so that the jet arrives at the deflecting surface when the jet is in its third phase.

In accordance with a preferred embodiment of the present invention, the cutting device is comprised of several jets arranged in a row for the simultaneous cutting of a web into a large number of partial webs. In this case, it is practical for the collecting receptacle to extend along the row for use in collecting the jets from all of the nozzles.

To dependably prevent the exit of spray from the collecting receptacle and, if required, to draw off water which was atomized during cutting, it is preferred that the collecting receptacle can be evacuated or connected to a vacuum source.

The device for cutting paper webs in accordance with the present invention can also be used for the cutting of webs consisting of several layers of paper placed on top of each other. In such a case, the distance between the jet and the web should preferably be selected to lie in the upper range of the spacing intervals mentioned above, in order to assure that the jet impinges on the web while the jet is in its second phase.

BRIEF DESCRIPTION OF THE DRAWINGS

A preferred embodiment of the present invention is represented in the drawings and will be described in greater detail in what follows.

Shown are in:

FIG. 1, a schematic side elevation of a device for cutting paper webs in accordance with the present invention, FIG. 2, a top plan view of a portion of the device shown in FIG. 1, FIG. 3, an enlarged side elevation view of a cutting device for use in the device shown in FIG. 1, FIG. 4, an axial cross section of a nozzle which can be used with the device for cutting in accordance with the present invention, and in FIG. 5, a schematic of an advantageous employment of the device in accordance with the invention.

DESCRIPTION OF THE PREFERRED EMBODIMENT

Figure 3:
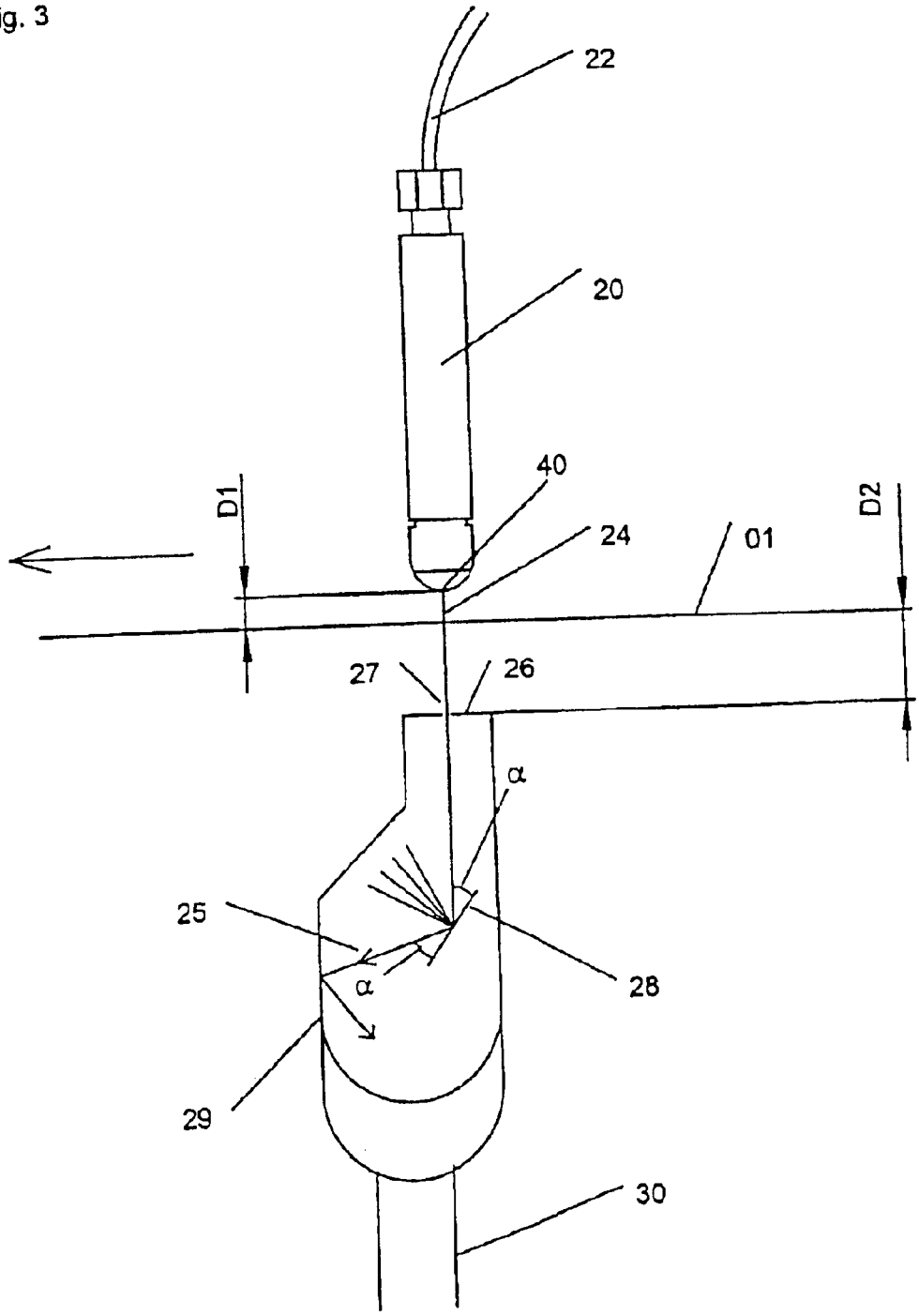

Referring initially to FIG. 1 there is shown the device for cutting paper webs in accordance with the present invention. The device is arranged above the superstructure of a folding apparatus and thus is located at a height of a few meters above the floor of a structure in which the folding apparatus has been placed. It receives a paper web 01 from a web-fed rotary printing press, which has also been placed next to it on the floor of the structure. The web-fed rotary printing press, the superstructure and the folding apparatus can be of any known type. They are not represented in the drawing figure and will not be described in detail.

The paper web 01 runs from a lower located printing press obliquely from below in the direction of the arrow 02 into the device for cutting. There, the paper web 01 is guided over a plurality of rollers 03, 04, 05, 06, each of which is maintained between two lateral walls of the device. One of these lateral walls 07 is represented in the drawing figure.

One of these rollers is an adjusting roller 04 which is provided with a displaceable shaft for use in compensating for cutting differences in the paper web 01. A driven traction roller 05 for setting the web tension and a guide roller 06 are also provided in the path of travel of paper web 01, as seen in FIG. 1. From the guide roller 06, the paper web 01 is conducted in a generally horizontal plane transversely over an accessible gallery or chamber 08 to a guide roller 09. The gallery or chamber 08 makes access to the various rollers of the device available to operators for the purpose of performing maintenance work, or to draw a fresh paper web into the device. The water jet cutting device 10 in accordance with the present invention is mounted adjacent a horizontal section 11 of the paper web 01 between the guide rollers 06, 09. It cuts or divides the paper web 01 into a plurality of partial webs, which are fanned out downstream or after, in the direction of web travel, the guide roller 09 and are conducted on guide rollers 12 and further on turning bars 13, from where the partial webs are fed, turned by 90°, down to the superstructure of the folding apparatus.

For the sake of simplicity, only five guide rollers 12 and corresponding turning bars 13 are each represented in FIG. 1. In a typical actual application, their number would, for example, be 13, with a typical width of the paper web 01 on an order of magnitude of 3.60 m.

The water jet cutting device 10 includes a plurality of nozzle holders 20, which are each supplied from a high-pressure pump, or from a pressure transformer, which is not specifically represented, with water at a pressure between 3500 and 4200 bar, typically 3800 bar. Each holder 20 supports a nozzle, represented in detail in FIG. 4, for use in generating a high-pressure water jet. These nozzle holders 20 are mounted on a support rod 21 that extends over the entire width of the cutting device between the lateral wall 07.

FIG. 2 shows a view from above of a portion of the device of FIG. 1, in which the support rod 21 with four nozzle holders 20, mounted on it by means of clamps 23, can be clearly seen.

FIG. 3 shows a detailed view of the water jet cutting device of FIG. 1. The nozzle holder 20 is a cylindrical hollow body made of metal. A feed line 22 is screwed to its upper end, and through which the nozzle holder 20 can be charged with high-pressure water from a suitable high pressure pump. A nozzle 40, with an outlet diameter of 0.1 mm, is located at the lower end of the nozzle holder 20, and through which a high-pressure water jet 24 exits for cutting the paper web 01, which is being conveyed in the direction of the arrow. The exit velocity of the water jet 24 is determined by the pressure of the water upstream of the nozzle. At a pressure of approximately 3800 bar, an exit velocity of approximately 800 m/s results, which exit velocity is more than half the speed of sound in water of 1500 m/s.

With a nozzle or jet diameter of 0.1 mm, the running or propogation time or travel time of a pressure or sound signal from one side of the jet 24 to the opposite side of the jet 24 is approximately 0.67 $\mu$s. During this time, the jet 24 travels a distance of approximately 0.54 mm. Since the transition of the jet from the first phase into the second phase presupposes the interaction of various areas of the jet 24 with each other, which interactions cannot be propagated in the jet 24 faster than the speed of sound, it is obvious that the transition of the jet 24 into its second phase cannot take place before a sound signal has had time to move back and forth several times between opposite sides of the jet 24. In the time required for each back and forth movement, the jet moves approximately 1 mm. Therefore, as depicted in FIG. 3, for cutting a single layer paper web 01, a working distance D1 between the nozzle 40 and the paper web 01 is selected, which distance D1 is traveled by the jet 24 during a length of time corresponding to five to six running or propagation times of the sound transversely to the jet direction, in the present case a distance of approximately 3 mm.

After the jet 24 has penetrated the paper web 01, it enters a collecting receptacle 25, whose top 26 is situated at a distance D2 of approximately 10 mm from the paper web 01 and extends transversely to the paper web 10 and which has a jet receiving opening 27 for this jet 24 opposite each nozzle 40. The collecting receptacle 25 constitutes a substantially closed chamber, with the exception of the receiving openings 27 and of a drain opening 30, extending transversely to the running direction of the paper web 01. The diameter of the receiving opening 27 corresponds approximately to the distance D2 between the top 26 of the receptacle 25 and the paper web 01. Portions of the jet 24, paper dust, and spray which were possibly laterally deflected in the course of the penetration of the paper web 01 by the water jet 24 are dependably caught in the receiving opening 27.

The jet 24 travels a distance of approximately 10 to 15 cm in the interior of the collecting receptacle 25 before impinging on a deflecting surface 28 in the form of, for example, a steel plate, whose normal surface extension forms an angle $\alpha$ of approximately 45° or more with the jet 24. The distance between the deflecting surface 28 and the jet 40 has been selected to be such that the jet 24, which has been slowed down on its way through the paper web 01 and the air, will no longer perform any noticeable cutting effect. A second deflection surface 29 is a portion of the housing of the collecting receptacle 25. It is arranged in such a way that it is hit by a large portion of the jet water spread from the first deflecting surface 28.

The water flows off from the deflecting surfaces 28, 29 toward the bottom of the collecting receptacle 25, which bottom surface is shaped in the form of a gutter that is inclined toward the drain opening 30. The water can flow off through the drain opening 30 by the action of gravity alone. However, it is possible to also connect a suction pump, that is not specifically represented, to the drain opening 30 in order to aspirate water spray and/or paper dust out of the zone in which the jet 24 cuts the paper web 01 into the collecting receptacle 25, if required. Because of the high pulsation of the jet 24, such dust is generated, if at all, only on the side of the paper web 01 facing away from the jet 40, so that aspiration on this side of the paper web 01 is entirely sufficient, and a second aspirating device on the side of the paper web 01 adjacent to the water jet 40 can be omitted.

Figure 4:
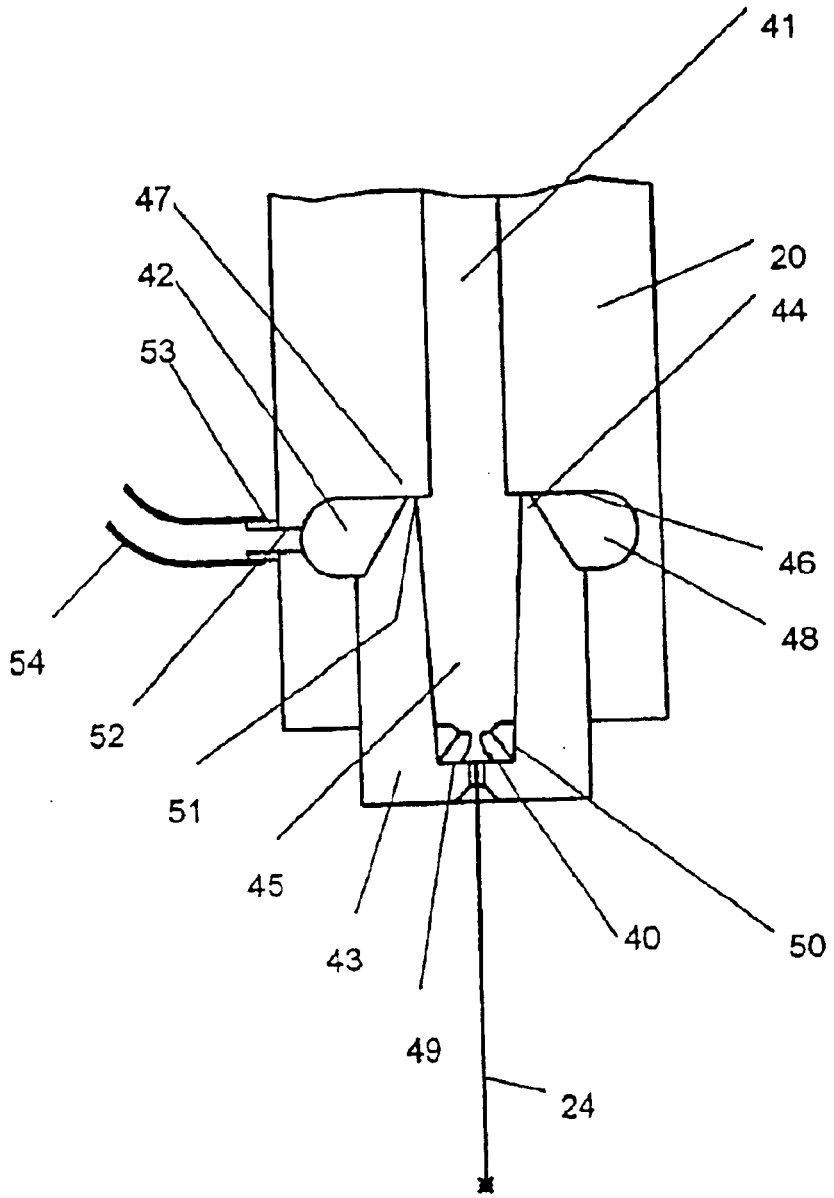

FIG. 4 shows a preferred embodiment of a possible configuration of the lower area of the nozzle holder 20 with the nozzle 40 shaping the jet 24. The nozzle holder 20 is a substantially cylindrical body of metal, for example stainless steel, with a centered longitudinal channel 41, which channel 41 is connected to the pressurized water feed line 22 at its upper end in a manner that is not represented. On the lower end of the nozzle holder 20, the longitudinal channel 41 terminates in a cylindrical or annular section 42, that is open toward the bottom and widened, and whose inner wall has an interior screw thread. An insert 43, which has a lower cylindrical section and an upper section 44 in the shape of a truncated cone, has been screwed into this interior screw thread. A bore 45, which tapers toward the bottom, extends the longitudinal channel 41 into the insert 43.

The nozzle 40, which is a ring made of a hard alloy, rests on a shoulder 49 on the bottom of the tapering bore 45. It is fixed in place in this position by a seal ring 50, which is also pressed against the shoulder 49 by the water pressure prevailing in the bore 45, and in this way centers the nozzle 40. The nozzle 40 has a clear or unobstructed diameter of 0.1 mm. This nozzle diameter has been proven to be particularly suited for cutting paper since, on the one hand, the narrow diameter leads to a small water throughput through the nozzle 40 and therefore to a small danger of moistening the cut paper while, on the other hand, the momentum of the jet at the admission pressure used is still high enough for cleanly cutting the paper web 01, even at high web speeds.

The upper section 44 of the insert 43, which is in the shape of a truncated cone, terminates in a sharp edge 51, which, in the course of screwing the insert 43 into the cylindrical or annular section 42, is pressed against a front face 46 of the widened section 42 in order to provide a seal, for example by cold welding, between the nozzle holder 20 and the insert 43. To make such a seal easier, or to improve it, a ring 47 of a soft metal, such as copper, can be inserted into the front face 46 in the area of the edge 50 as indicated in FIG. 4 by dashed lines.

In case the seal between the insert 43 and the nozzle holder 20 is not perfect, an annular hollow chamber 48, which extends all around the insert upper section 44, and is in the shape of a truncated cone, has been provided in the nozzle holder 20, and receives any water that may penetrate between the edge 51 and the upper interior surface. The hollow chamber 48 is connected via a radial bore 52, through which the water can escape, with the surroundings. Since in no case is this water to be allowed to drip on the paper web 01 to be cut, the bore 52 is extended on the outside by means of a connector 53, onto which a hose 54 for carrying off the water has been pushed. Since the water in the hollow chamber 48 is essentially at atmospheric pressure, no particular demands are being made on the pressure resistance of the hose 54 and its fastening to the connector 53. A simple hose clamp, for example, is entirely sufficient for fixing the hose 54 in place.

Figure 5:
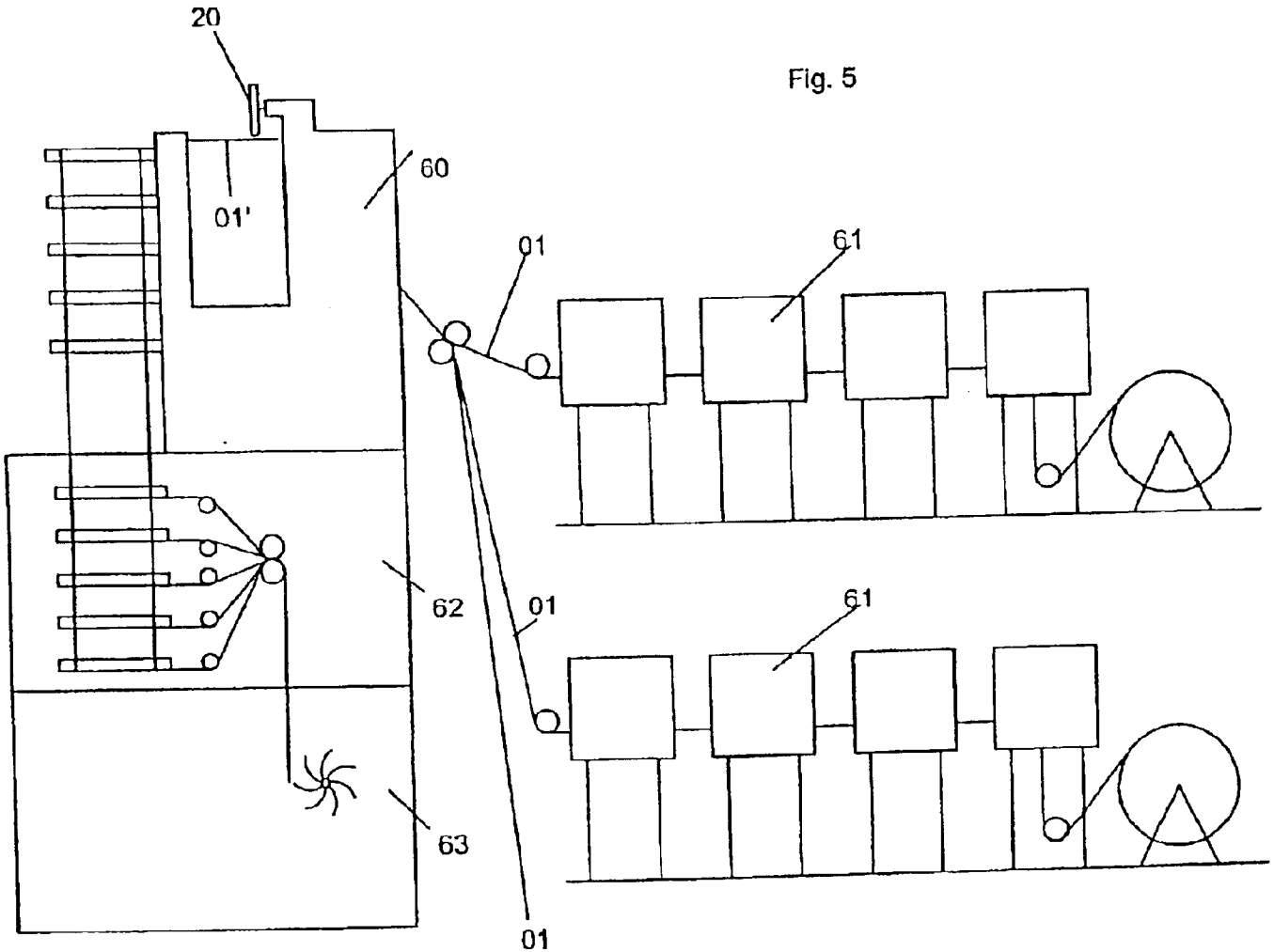

FIG. 5 schematically depicts a further development of the device for cutting a paper web in accordance with the present invention, which here has been provided with the reference symbol 60 as a whole. Paper webs 01 from several printing presses 61 which paper webs 01, in accordance with the present invention are placed on top of each other, to form a multilayered paper web 01' built up from several individual webs, are cut by the device at the inlet of the device 60. Multilayered partial webs are obtained in this way at the outlet of the device 60, and the number of partial webs which must be brought together in the superstructure 62 of the folding apparatus 63 in order to put together a brochure of a predetermined number of pages, for example, is reduced. It is also conceivable to convey the cut multilayered partial webs to the folding apparatus 63 without the interposition of a superstructure.

For cutting the multilayered paper web 01' it is useful that the jet 24 is in the second phase, therefore the distance D1 between the nozzle 40 and the paper web 01' is selected to be greater than indicated above in relation to FIG. 3. The distance D1 can be up to ten times the sonic running or propagation time transversely to the jet direction.

While a preferred embodiment of a device for cutting a paper web in accordance with the present invention has been set forth fully and completely hereinabove, it will be apparent to one of skill in the art that a number of changes in, for example the type of printing press used to print the web, the source of the water under pressure and the like could be made without departing from the true spirit and scope of the present invention which is accordingly to be limited only by the following claims.

What is claimed is:

1. A device for cutting paper webs into a plurality of partial webs comprising:

a web-fed rotary printing press having a printing unit and a folding apparatus adapted for folding cut partial webs, said folding apparatus having an inlet; and a water jet cutting device positioned in said web-fed rotary printing press between said printing unit and said folding apparatus inlet, said water jet cutting device having a nozzle.

2. The device of claim 1 wherein said nozzle has a diameter of 0.1 mm.

3. The device of claim 1 wherein the paper webs to be cut are spaced from said nozzle at a distance of 2 to 5 mm.

4. The device of claim 1 further including means for moving paper webs to be cut past said water jet cutting device at a speed of 14 to 18 m/s.

5. The device of claim 1 further including means supplying water to said nozzle at a pressure of between 3500 bar and 4000 bar.

6. The device of claim 1 wherein said nozzle has a diameter and further including a jet of water issuing from said nozzle, said jet of water having a diameter and a velocity and wherein said nozzle is spaced at a distance from the paper webs being cut, said distance being said jet of water velocity times three to ten times a sonic propagation time across said jet of water diameter.

7. The device of claim 1 further including a water jet collecting receptacle placed 5 to 15 mm from the paper webs.

8. The device of claim 7 further including at least one deflecting surface in said water jet collecting receptacle, said at least one deflecting surface being arranged obliquely to a water jet travel direction and being operative to slow said water jet.

9. The device of claim 7 further including a plurality of said nozzles arranged in a row of nozzles, said water jet collecting device being sized to underlie said row of nozzles.

10. The device of claim 7 further including means to evacuate said water jet collecting receptacle.

11. The device of claim 1 wherein the paper webs are arranged on top of each other.

12. The device of claim 1 wherein the paper webs are printed.

13. A device for cutting paper webs comprising:

a water jet cutting device having a nozzle, said nozzle being spaced from a paper web to be cut by a distance, said nozzle having a nozzle diameter; and a jet of water issuing from said nozzle, said jet of water having a diameter and a velocity, said distance being said jet of water velocity times three to ten times a sonic propagation time across said jet of water diameter.

14. The device of claim 13 wherein said nozzle has a diameter of 0.1 mm.

15. The device of claim 13 wherein the paper webs to be cut are spaced from said nozzle at a distance of 2 to 5 mm.

16. The device of claim 13 further including means for moving paper webs to be cut past said water jet cutting device at a speed of 14 to 18 m/s.

17. The device of claim 13 further including means supplying water to said nozzle at a pressure of between 3500 bar and 4000 bar.

18. The device of claim 13 further including a water jet collecting receptacle placed 5 to 15 mm from the paper webs.

19. The device of claim 18 further including at least one deflecting surface in said water jet collecting receptacle, said at least one deflecting surface being arranged obliquely to a water jet travel direction and being operative to slow said water jet.

20. The device of claim 18 further including a plurality of said nozzles arranged in a row of nozzles, said water jet collecting device being sized to underlie said row of nozzles.

21. The device of claim 18 further including means to evacuate said water jet collecting receptacle.

22. The device of claim 13 wherein the paper webs are arranged on top of each other.

23. The device of claim 13 wherein the paper webs are printed.

24. A device for cutting paper webs comprising:

a water jet cutting device having a nozzle;

means supplying water to said nozzle at a pressure of between 3500 bar and 4000 bar and;

means for moving paper webs to be cut past said water jet cutting device at a speed of 14 to 18 m/s.

25. The device of claim 24 wherein said nozzle has a diameter of 0.1 mm.

26. The device of claim 24 wherein the paper webs to be cut are spaced from said nozzle at a distance of 2 to 5 mm.

27. The device of claim 24 wherein said nozzle has a diameter and further including a jet of water issuing from said nozzle, said jet of water having a diameter and a velocity and wherein said nozzle is spaced at a distance from the paper webs being cut, said distance being said jet of water velocity times three to ten times a sonic propagation time across said jet of water diameter.

28. The device of claim 24 further including a water jet collecting receptacle placed 5 to 15 mm from the paper webs.

29. The device of claim 28 further including at least one deflecting surface in said water jet collecting receptacle, said at least one deflecting surface being arranged obliquely to a water jet travel direction and being operative to slow said water jet.

30. The device of claim 28 further including a plurality of said nozzles arranged in a row of nozzles, said water jet collecting device being sized to underlie said row of nozzles.

31. The device of claim 28 further including means to evacuate said water jet collecting receptacle.

32. The device of claim 24 wherein the paper webs are printed.

33. A device for cutting paper webs comprising:

a water jet cutting device having a nozzle; and means supporting said nozzle at a distance of 2 to 5 mm from a paper web to be cut.

34. The device of claim 33 wherein said nozzle has a diameter of 0.1 mm.

35. The device of claim 33 further including means for moving paper webs to be cut past said water jet cutting device at a speed of 14 to 18 m/s.

36. The device of claim 33 further including means supplying water to said nozzle at a pressure of between 3500 bar and 4000 bar.

37. The device of claim 33 wherein said nozzle has a diameter and further including a jet of water issuing from said nozzle, said jet of water having a diameter and a velocity and wherein said nozzle is spaced at a distance from the paper webs being cut, said distance being said jet of water velocity times three to ten times a sonic propagation time across said jet of water diameter.

38. The device of claim 33 further including a water jet collecting receptacle placed 5 to 15 mm from the paper webs.

39. The device of claim 38 further including at least one deflecting surface in said water jet collecting receptacle, said at least one deflecting surface being arranged obliquely to a water jet travel direction and being operative to slow said water jet.

40. The device of claim 38 further including a plurality of said nozzles arranged in a row of nozzles, said water jet collecting device being sized to underlie said row of nozzles.

41. The device of claim 38 further including means to evacuate said water jet collecting receptacle.

42. The device of claim 33 wherein the paper webs are arranged on top of each other.

43. The device of claim 33 wherein the paper webs are printed.

44. A device for cutting paper webs comprising:

a water jet cutting device having a nozzle; and means supplying water to said nozzle at a pressure of between 3500 bar and 4000 bar, and wherein the paper webs are arranged on top of each other.

* * * * *